US006899243B1

(12) United States Patent
Götesson

(10) Patent No.: US 6,899,243 B1
(45) Date of Patent: May 31, 2005

(54) WASTE BIN ASSEMBLY

(75) Inventor: Ola Götesson, Dalstorp (SE)

(73) Assignee: Götessons Industri AB, Dalstorp (SE)

( * ) Notice: Subject to any disclaimer, the term of this patent is extended or adjusted under 35 U.S.C. 154(b) by 0 days.

(21) Appl. No.: 09/831,201

(22) PCT Filed: Nov. 6, 1999

(86) PCT No.: PCT/SE99/02018

§ 371 (c)(1),
(2), (4) Date: May 21, 2001

(87) PCT Pub. No.: WO00/27731

PCT Pub. Date: May 18, 2000

(30) Foreign Application Priority Data

Nov. 6, 1998 (SE) ..... 9803792

(51) Int. Cl.[7] ..... B65D 21/02
(52) U.S. Cl. ..... 220/23.4
(58) Field of Search ..... 220/23.4, 908, 220/909, 23.2, 23.83, 23.86; 248/324, 145, 907

(56) References Cited

U.S. PATENT DOCUMENTS

| | | | | | |
|---|---|---|---|---|---|
| 130,931 | A | * | 8/1872 | Moore | 248/145 |
| 367,802 | A | * | 8/1887 | Ford et al. | 248/145 |
| 1,207,598 | A | * | 12/1916 | Moon | 248/145 |
| 1,238,320 | A | * | 8/1917 | Moon | 248/145 |
| 1,309,776 | A | * | 7/1919 | Powers | 248/145 |
| 1,888,127 | A | | 11/1932 | Hearne | |
| 1,961,922 | A | | 6/1934 | Brabdstetter | |
| 4,736,915 | A | | 4/1988 | Miller et al. | |
| 4,971,234 | A | * | 11/1990 | Hay | 211/131.1 |
| 5,101,997 | A | * | 4/1992 | Bagwell et al. | 220/23.4 |
| 5,149,031 | A | | 9/1992 | Henri | |

* cited by examiner

*Primary Examiner*—Stephen Castellano
(74) *Attorney, Agent, or Firm*—Cohen, Pontani, Lieberman & Pavane

(57) ABSTRACT

A waste bin assembly for sorting and emptying of wastes disposed therein is disclosed. The waste bin assembly comprises at least two compartments which are hung on a vertical shaft that is mounted beneath a work table and rotatable by means of a bearing and mounting arrangement at the upper end of the shaft. The compartments are detachably hung on the shaft.

6 Claims, 2 Drawing Sheets

WASTE BIN ASSEMBLY

The present invention is for a waste bin with an option of waste sorting.

Waste bins for collecting of wastes of various kinds are used at most places of work and at many other places. It is then desirous that the wastes can be sorted into at least two fractions. For reasons of space availability this is often unsuitable or impossible which means that the wastes are put unsorted into the same container with the accompanying disadvantages.

The invention may be said to be a recovery and waste station within a minimal space at a local place of work. The object of the present invention is a waste bin which can be emptied and enables sorting of wastes into at least two fractions and which may be used even at minimal spaces. One fraction may be burnable and recoverable paper while the other fraction includes other wastes such as plastics, tape, fruit peel etc. It is another object of the invention that all collecting compartments which are parts of the waste bin shall be made easily accessible when the respective kind of waste shall be disposed of. A further object of the invention is that it shall be possible to mount the waste bin on to the underside of a work table or the like so that floor space is saved. The waste bin of the invention has the characteristics which are apparent from claim 1, embodiments of the invention have those characteristics which are apparent from the other claims.

The invention will below be described with reference to the example of an embodiment thereof which is shown in the enclosed figures.

Figure 1:
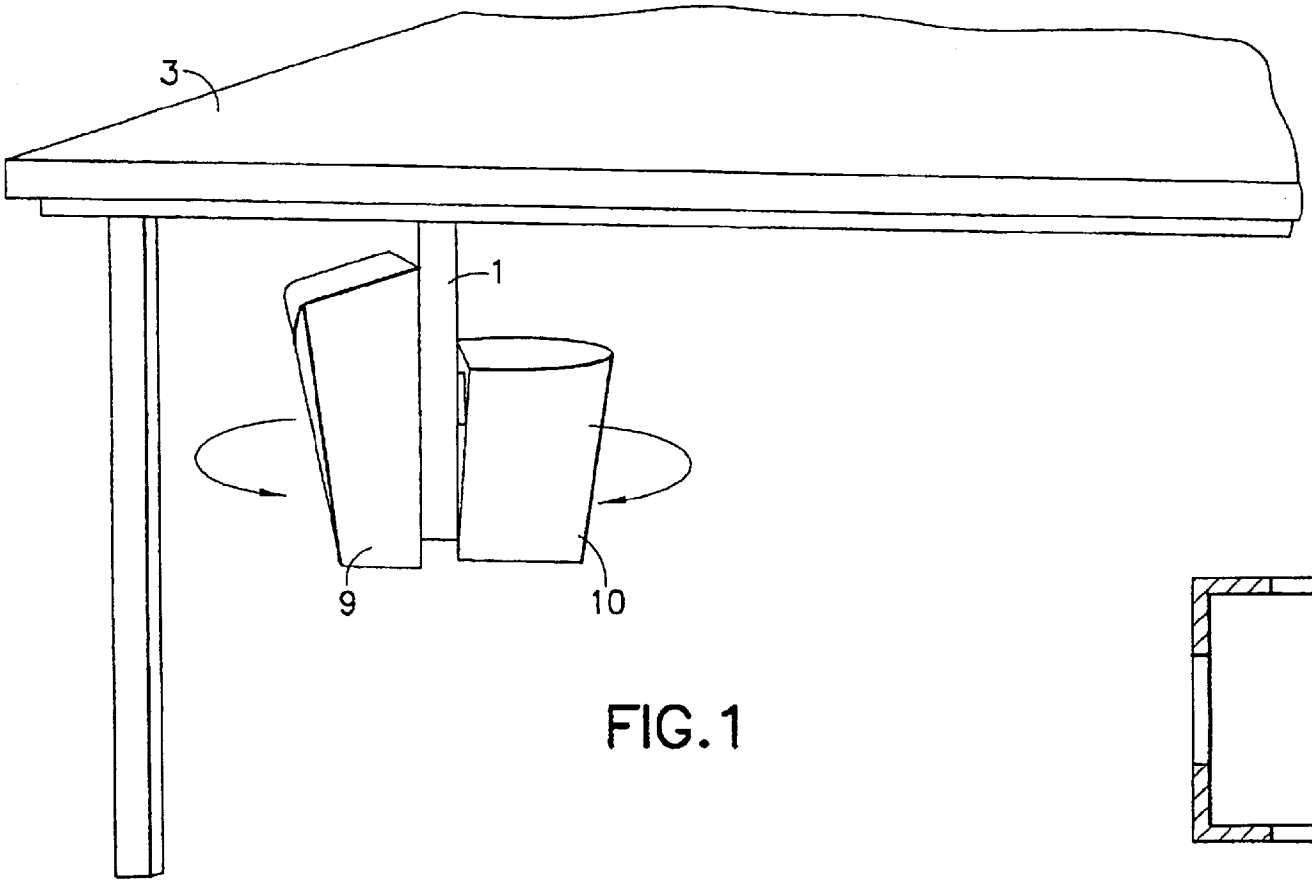
FIG. 1 shows a waste bin according to the invention which is mounted under a work table.
Figure 3:
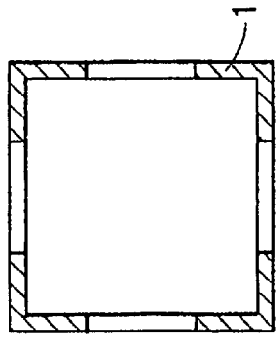
FIG. 3 is a cross-sectional view of the central shaft taken at Section A—A of FIG. 2.
Figure 2:
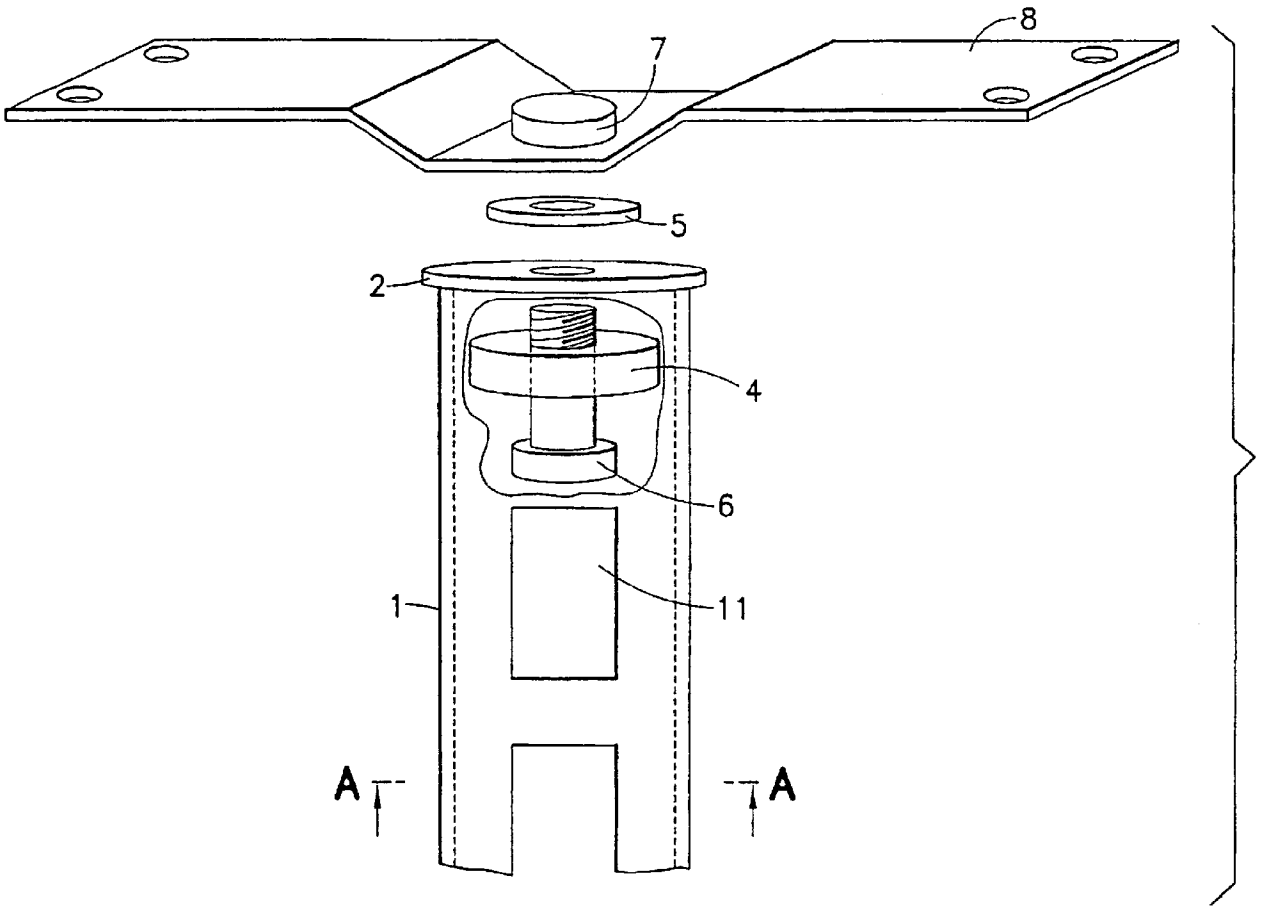
FIG. 2 is a blow up of parts of the means for bearing and mounting.

The device comprises a central shaft 1 made from tubular square hollow profile which is arranged vertically. On each side of the square profile there are several through bores 11 for the hanging up of boxes or compartments 9, 10. Although two boxes are shown by way of example, the shaft may also support the hanging of more than two compartments or boxes. The boxes are easily detachable by being hooked at the openings in a suitable way.

Fixed to the upper end of the shaft 1 by welding or otherwise there is a plate 2 having a central hole for a bolt 6. The bolt is a shaft for an axial bearing 4 and it is at its upper end mounted at a mounting plate 8 by means of a locknut 7. A sliding plate 5 is arranged between the mounting plate 8 and the plate 2. The mounting plate 8 has a suitable number of holes for fastening by means of screws on the underside of a worktable 3.

Other varieties and embodiments are possible within the frame of the inventive idea. For example the shaft may instead of being a tube comprise several, vertical bars at which the boxes are hung up. The number of boxes may vary but two boxes is often sufficient for normal office use.

What is claimed is:

1. A waste bin assembly mountable only to an underside of an elevated work surface for receiving and accommodating waste deposited into the assembly such that the waste bin assembly is suspended entirely from the underside of the elevated work surface without additional support from an underlying floor surface above which the work surface is elevated, said waste bin assembly comprising:

a plurality of waste-receiving compartments each configured and disposed for accommodating articles of waste selectively depositable by a user into said each compartment;

a mounting unit constructed and positioned for securement of the mounting unit directly to the underside of the elevated work surface for suspending the plural waste-receiving compartments from the elevated work surface;

an elongated shaft extending from the mounting unit at one end of the shaft to the plural waste-receiving compartments at an opposite end of the shaft, said plural waste-receiving compartments being detachably secured to said shaft so as to suspend the plural waste-receiving compartments on the shaft from the underside of the elevated work surface such that the waste bin assembly and the shaft opposite end are suspended in hanging relation from the underside of the elevated work surface without direct support of the waste bin assembly from the underlying floor surface above which the work surface is elevated; and a bearing in said mounting unit for enabling selective axial rotation, relative to the mounting unit, of the shaft and, with said shaft, of the plural waste-receiving compartments detachably secured to the shaft for facilitating enhanced user access to selected individual ones of the plural waste-receiving compartments through selective user-rotation of the shaft relative to the mounting unit and the underside of the elevated work surface to which the mounting unit is secured.

2. A waste bin assembly bin accordance with claim 1, wherein said elongated shaft comprises a hollow tube having a substantially square cross-section.

3. A waste bin assembly bin accordance with claim 1, wherein each of said plural waste-receiving compartments is individually detachable from said shaft for selective emptying of said each compartment of waste articles accommodated in said each compartment.

4. A waste bin assembly in accordance with claim 1, wherein said elongated shaft comprises a hollow tube that includes a plurality of bores defined therein for detachable hooked engagement of said waste-receiving compartments with said bores.

5. A waste bin assembly bin accordance with claim 1, wherein each of said waste receiving compartments includes an opening through which articles of waste are selectively depositable into said each waste receiving compartment, and wherein said mounting unit is disposed, when the waste bin assembly is secured for use to the underside of the elevated work surface, in spaced relation above said openings of said plural waste receiving compartments.

6. A waste bin assembly in accordance with claim 1, wherein each of said waste receiving compartments includes an opening through which articles of waste are selectively depositable into said each waste receiving compartment, and wherein said elongated shaft one end extends, when the waste bin assembly is secured for use to the underside of the elevated work surface, above and beyond said openings of said plural waste receiving compartments.

* * * * *